United States Patent [19]

Blackman

[11] Patent Number: 4,799,594

[45] **Date of Patent: * Jan. 24, 1989**

[54] VENDING AND RECLOSURE DEVICE FOR POWDER AND GRANULAR PRODUCTS

[75] Inventor: Stephen M. Blackman, Westmont, Ill.

[73] Assignee: Federal Paper Board Co., Inc., Montvale, N.J.

[ * ] Notice: The portion of the term of this patent subsequent to Nov. 17, 2004 has been disclaimed.

[21] Appl. No.: 112,235

[22] Filed: Oct. 26, 1987

Related U.S. Application Data

[63] Continuation-in-part of Ser. No. 930,400, Nov. 14, 1986, Pat. No. 4,706,875.

[51] Int. Cl.[4] ..... B65D 5/08; B65D 5/16; B65D 5/72

[52] U.S. Cl. ..... 206/626; 229/125

[58] Field of Search ..... 206/625, 626; 229/125

[56] References Cited

U.S. PATENT DOCUMENTS

| | | | |
|---|---|---|---|
| Re. 25,449 | 9/1963 | Gill | 206/625 |
| 1,712,249 | 5/1929 | Byrne | 206/626 |
| 1,773,553 | 8/1930 | Taylor et al. | 206/626 |
| 2,360,415 | 10/1944 | Gilbert | 206/626 |
| 2,473,492 | 6/1949 | Shina | 206/626 |
| 3,181,767 | 5/1965 | Starkey | 206/626 |
| 3,270,946 | 9/1966 | Redpath et al. | 206/626 |
| 3,315,873 | 4/1967 | Strange | 206/626 |
| 3,395,848 | 8/1968 | Johnson | 206/626 |
| 4,706,875 | 11/1987 | Blackman | 206/626 |

*Primary Examiner*—Stephen P. Garbe

*Attorney, Agent, or Firm*—Charles E. Brown; Charles A. Brown

[57] ABSTRACT

A vending and reclosure device for powder and granular products. The device is formed of two container panels disposed in overlying relation with respect to each other with an inner one of the two panels having dispensing openings therethrough and the outer one of the panels having formed therein a closure flap which is normally initially free at one end and is connected to the outer panel along sides thereof by way of lines of weakening having projecting curved intermediate portions which, when ruptured permit the closure flap to be pivoted at a hinged end thereof out of the plane of the outer panel and away from overlying relation with respect to the dispensing openings in the inner panel. The inner panel is provided with cut lines generally aligned with the lines of weakness. When the closure flap is removed the lines of weakness define curved projections along the opposite sides thereof and the cut lines in the inner panel define shoulders behind which the projections can lock.

14 Claims, 1 Drawing Sheet

VENDING AND RECLOSURE DEVICE FOR POWDER AND GRANULAR PRODUCTS

This application is a continuation-in-part of my earlier filed copending application Ser. No. 930,400 filed Nov. 14, 1986, now U.S. Pat. No. 4,706,875.

This invention relates in general to new and useful improvements in containers having vending means and more particularly to an improved vending and reclosure device suitable for dispensing powder and granular products.

This invention in particular relates to an improvement over the resealable container disclosed in U.S. Pat. No. 4,308,956 granted to John J. Steinke et al on Jan. 5, 1982.

Most particularly, the invention relates to a resealable container which includes inner and outer panels disposed in overlapping relation with the inner panel defining a dispensing opening and the outer panel having formed therein a closure flap overlying the dispensing opening.

Most specifically, the outer panel has spaced side edges add the closure flap is positioned between the outer panel side edges in spaced relation to the side edges with the closure flap having side edges and ends. The side edges of the closure flap are defined by lines of weakening which in the formation of the container maintain the closure flap integral with the outer panel until the container is initially opened. The lines of weakening have intermediate arcuate portions projecting towards adjacent outer panel side edges. The inner panel is provided with cut lines underlying and being generally aligned with the lines of weakening with the exception of the arcuate intermediate portions and the cut lines define on the inner panel shoulders behind which the closure flap arcuate projections which result when the closure flap is separated from the remainder of the outer panel along the lines of weakening, engage to retain the closure flap in its dispensing opening closing position.

The resealable container of this invention is advantageously a carton formed of paperboard or like material and the closure flap may be provided with a projecting tab at that end thereof which is hingedly connected to the remainder of the outer panel for retaining the closure flap in a container open position.

With the above and other objects in view that will hereinafter appear, the nature of the invention will be more clearly understood by reference to the following detailed description, the appended claims, and the several views illustrated in the accompanying drawing.

Figure 3:
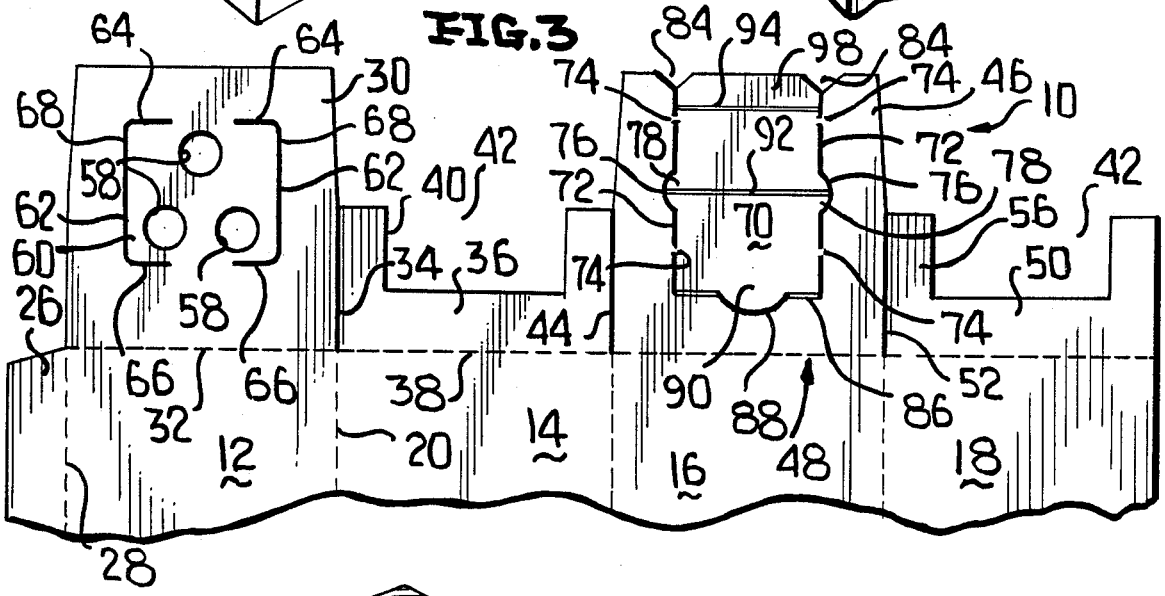
FIG. 3 is a fragmentary plan view of a blank for forming the container of FIGS. 1 and 2.
Figure 4:
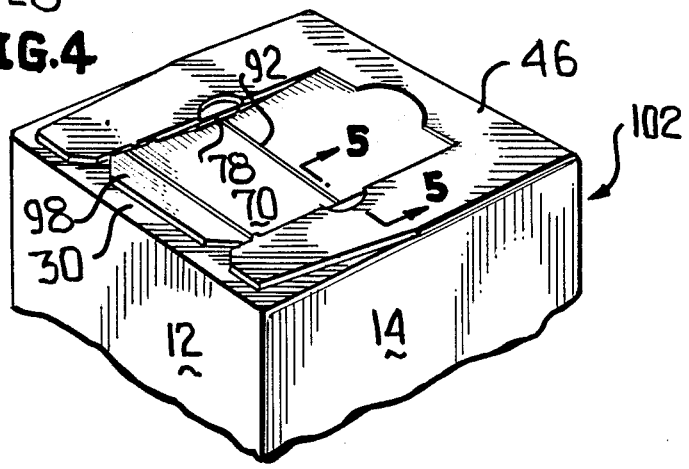
FIG. 4 is another fragmentary top perspective view similar to FIG. 2 and shows the central portion of the closure flap depressed downwardly towards the interior of the container with the edge projections of the closure flap locked behind shoulders on the inner panel to retain the closure flap in its dispensing opening closing position.

Referring now to the drawings in detail, reference is first made to FIG. 3 wherein there is illustrated a blank for forming a container or carton in accordance with this invention, the blank being generally identified by the numeral 10. The blank 10 is preferably formed of paperboard and includes body panels 12, 14, 16 and 18 integrally connected together along fold lines 20, 22, 24, respectively. The body forming portion of the blank 10 also includes a flap 26 which is connected to the body panel 12 along a fold line 28 and which is bondable to the body panel 18 in a conventional manner.

One end of the blank 10 defines one end of the container which is the subject of this invention. That one end of the blank 10 includes an inner panel 30 which is joined to one end of the body panel 12 along a fold line 32. Next to the inner panel 30, but separated therefrom by a cut line 34, is an innermost half panel 36 which is joined to the body panel 14 along a fold line 38 which may be a continuation of the fold line 32. The panel 36 is notched as at 40 to define one half of an opening 42.

Next to the panel 36 and separated therefrom by a cut line 44 is an outer panel 46. The outer panel 46 is joined to the body panel 16 along a fold line 48 which may be a continuation of the fold lines 32, 38.

The one end of the blank 10 further includes a second innermost half panel 50 which is of the same configuration as the half panel 36 and is separated from the outer panel 46 along a cut line 52. The half panel 50 is joined to the body panel 18 at one end thereof along a fold line 54 which is a continuation of the fold line 48. That end of the half panel 50 remote from the fold line 54 is notched as at 56 to define a second half of the opening 42.

It is to be understood that the opposite end of the blank 10 is provided with other panels which, when the blank is erected, will define an opposite end of the resultant container.

Returning now to the inner panel 30, it will be seen that it is provided with at least one dispensing opening 58, three such openings 58 being illustrated. The openings 58 are formed in a panel portion 60 which is defined along opposite sides thereof by elongated cut lines 62. The cut lines 62, remote from the fold line 32, are provided with extensions 64 which converge in opposed relation, but which terminate short of one another. The opposite ends of the cut lines 62 terminate in extensions 66 which are disposed in converging relation. The cut lines 62 and their extensions 64, 66 permit the panel portion 60 to be depressed so as to define in the inner panel 30 along the cut lines 62 shoulders 68.

A major portion of the outer panel 46 is in the form of a closure flap 70. The closure flap 70 is defined along side edges thereof by lines of weakening 72 which extend to notches 84 formed in a free edge of the outer panel 46 remote from the fold line 48. The lines of weakening 72 terminate within the outer panel 46 adjacent to, but remote from the fold line 48. An interrupted fold line 86 extends between the inner ends of the lines of weakening 82 and is interrupted by an arcuate cut line 88. The cut line 88 defines a projecting tab 90 on the closure flap 70.

A central portion of the closure flap 70 may be provided with a transverse fold line 92 whose function will be described in detail.

A further transverse fold line 94 extends across the closure flap 80 between the lines of weakening 72. The fold line 94 sets off a terminal portion 98 of the closure flap 70.

When the blank 10 is erected, it forms a container 102 which is generally in the form of an upstanding carton having a closed bottom (not shown) and a closed top. The container 102 will, of course, be filled before one of the bottom and top is formed.

In the formation of the top, the half panels 36, 50 are first folded into alignment with one another, after which the inner panel 30 is folded into overlying relation with respect to the half panels. If desired, the underside of the inner panel 30 may be bonded to the upper surface of the half panels 36, 50.

At this time it is pointed out that the opening 42 defined by the half panels 36, 50 is of a size so as to not interfere with either the dispensing of the product through the opening 58 or the downward deflection of the panel portion 60.

Finally, the outer panel 46 is folded into overlying relation with respect to the inner panel 30 and those portions of the outer panel 46 outwardly of the closure flap 70 are bonded to the upper surface of the inner panel 30.

The container is now complete ready for shipment and eventual use by the ultimate purchaser.

Referring now most specifically to the lines of weakening 72, it is to be understood that the nature of these lines is such that initially the closure flap 70 is not separate and apart from the adjacent portions of the outer panel 46. This may be accomplished in several manners. For example, the lines of weakening 72 may be in the form of cut lines which do not extend entirely through the outer panel 46. On the other hand, the lines of weakening 72 may be in the form of cut lines which extend entirely through the outer panel 46 but are interrupted at intervals by way of bridges 74.

In any event, when it is desired to open the container 102, the terminal portion 98 of the closure flap 70 is lifted and then pulled upwardly so as to progressively rupture entirely through along the lines of weakening 72. When the closure flap 70 is fully lifted to the dispensing position of FIG. 2, the tab 90 reaches an overcenter position and holds the closure flap 70 in the dispensing position of the container 102 with the dispensing openings 58 uncovered.

It is to be noted that the lines of weakening 72 are primarily straight lines but have intermediate curved portions 76 which project transversely outwardly of the closure flap 70 towards adjacent side edges of the outer panel 46. These intermediate curved portions 76 of the lines of weakening 72 define projections 78. The projections 78 are preferably between the bridges 74.

Figure 1:
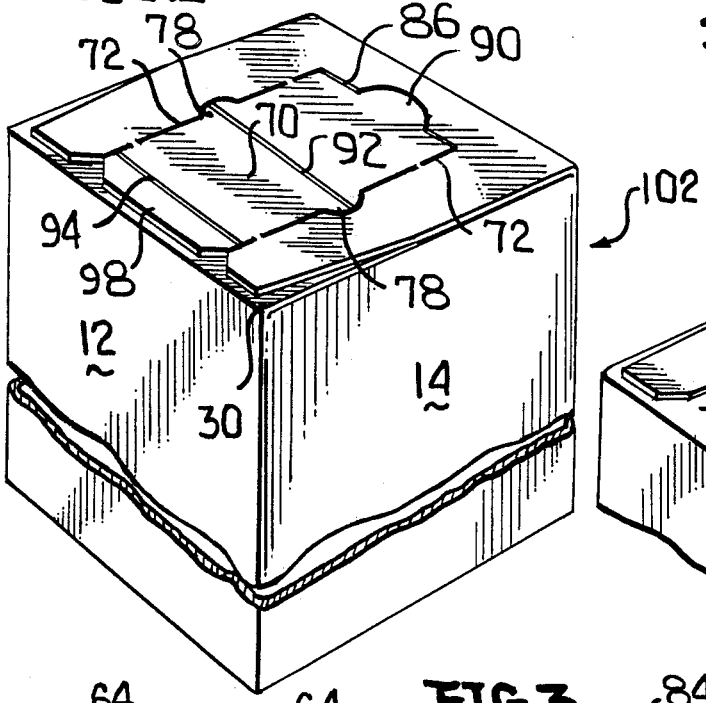
FIG. 1 is a top perspective view of a container in the form of a carton having formed in the top wall thereof the vending and reclosure device which is the subject of this invention.
Figure 2:
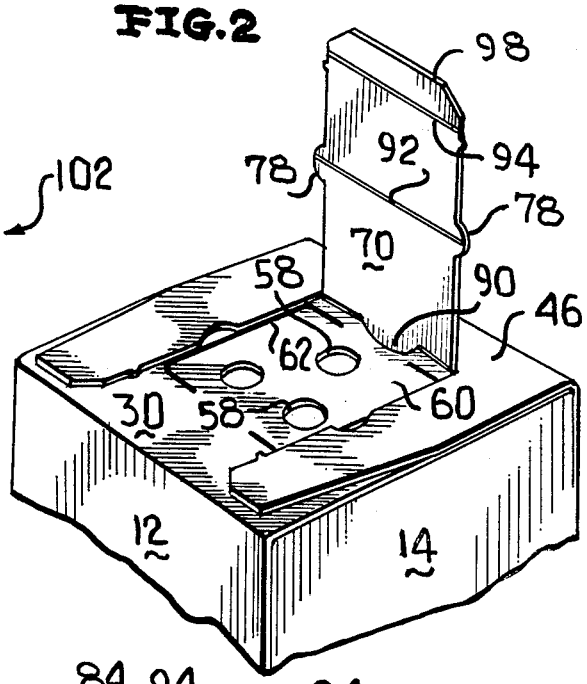
FIG. 2 is a fragmentary top perspective view similar to FIG. 1 and shows the closure flap having been separated from the outer panel except along one end thereof with the container ready for dispensing of a product.

After the dispensing operation is completed, the closure flap 70 is again moved back to its original position. However, it will now not be secured to the remainder of the outer panel 46 along the lines of weakening 72. However, as is best shown in FIG. 2, once the closure flap 70 has been separated from the adjacent portion of the outer panel 46, the closure flap 70 now has along each edge thereof one of the projections 78, the projections 78 being shaped in accordance with the curved configuration of the curved intermediate portion 76 of the lines of weakness 72.

Figure 5:
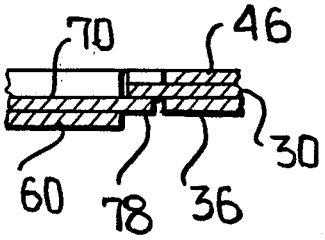
FIG. 5 is an enlarged fragmentary transverse sectional view taken generally along the line 5—5 of FIG. 4 and shows the manner in which the projections along the side of the closure flap interlock behind the inner panel in the central portion of the closure flap.

Because the cut lines 62 extend in alignment with the lines of weakness 72 with the exception of the curved intermediate portions 76, it will be seen that if the central portion of the closure flap is downwardly depressed, for example generally in the area of the fold line 92 which extends between the projections 78, the central portion of the closure flap 70 as well as the central portion of the panel part 60 will move downwardly. The curved projections 78 will then snap under the shoulders 68 to lock the closure flap in its reclosed position. This is best shown in FIG. 5.

When it is desired to reopen the container 102, it is merely necessary to once again lift the closure flap 70 by way of the terminal portion 98.

Although only a preferred embodiment of the vending and reclosure device has been specifically illustrated and described herein, it is to be understood that minor variations may be made therein without departing from the spirit and scope of the invention as defined by 10 the appended claims.

I claim:

1. A resealable container comprising inner and outer panels disposed in overlapping relation, said inner panel defining a dispensing opening, said outer panel having formed therein a closure flap overlying said dispensing opening, said outer panel having spaced side edges, said closure flap being positioned between said outer panel side edges in spaced relation to said side edges, said closure flap having side edges and ends, said closure flap side edges being defined by lines of weakening, each of said lines of weakening being generally in the form of a straight line having an arcuate intermediate portion projecting transversely towards an adjacent one of said outer panel side edges, one of said ends being defined by a fold line and the other of said ends being separable from said outer panel, whereby said closure flap may be partially separated from and hinged relative to said outer panel to uncover said dispensing opening upon completely rupturing said outer panel along said lines of weakening, said arcuate intermediate portions of said lines of weakening defining along each side edge of said closure flap a projection having a curved outline, and said inner panel having a cut line therein underlying and being generally aligned with each of said lines of weakening with the exception of said arcuate intermediate portions, said cut lines defining on said inner panel shoulders behind which said closure flap projections are engageable in the resealing of said container.

2. A resealable container according to claim 1 wherein said outer panel is secured to said inner panel between said lines of weakening and said outer panel side edges.

3. A resealable container according to claim 1 wherein said inner panel and said outer panel are end forming panels of said container.

4. A resealable container according to claim 1 wherein a central portion of said closure flap has a transverse fold line extending between said closure flap side edges for facilitating depressing of said closure flap side edge projections behind said inner panel shoulders.

5. A resealable container according to claim 1 wherein a central portion of said closure flap has a transverse fold line extending between said closure flap side edges at said arcuate intermediate projections for facilitating depressing of said closure flap side edge projections behind said inner panel shoulders.

6. A resealable container according to claim 1 wherein said dispensing opening is between said inner panel cut lines.

7. A resealable container according to claim 1 wherein said inner panel cut lines define an inwardly deflectable panel between said shoulders, the inwardly deflectability of said inner panel inwardly deflectable panel facilitating the engagement of said closure flap side edge projections behind said shoulders.

8. A resealable container according to claim 7 wherein each of said inner panel cut lines has at each end thereof an extension, and said extension at each end of said cut lines being disposed in converging relation.

9. A resealable container according to claim 1 wherein said fold line is interrupted by a projecting tab defined by a cut line in said outer panel, said tab forming means for holding said closure flap in an open position.

10. A resealable container according to claim 1 wherein said lines of weakening extend through an end edge of said outer panel.

11. A resealable container according to claim 1 wherein said closure flap has a transverse fold line adjacent said closure flap other end, said transverse fold line defining a terminal flap portion.

12. A resealable container according to claim 6 wherein said container also includes a pair of innermost panels underlying said inner panel, said innermost panels being half panels and having free ends in opposed relation; said innermost panels free ends being notched to define an opening of a size greater than that of said inwardly deflectable panel so as to not interfere with the engagement of said closure flap projections behind said shoulders.

13. A container blank comprising a plurality of panels integrally connected along a plurality of fold lines, said panels including two panels positioned relative to others of said panels for folding into overlapping relation, said two panels being identified as an inner panel and an outer panel, said inner panel defining a dispensing opening, said outer panel having formed therein a closure flap for overlying said dispensing opening, said outer panel having spaced side edges, said closure flap being positioned between said outer panel side edges in spaced relation to said side edges, said closure flap having side edges and ends, said side edges being defined by lines of weakening, each of said lines of weakening being generally in the form of a straight line having an arcuate intermediate portion projecting transversely towards an adjacent one of said outer panel side edges, one of said ends being defined by a fold line and the other of said ends being separable from said outer panel, whereby said closure flap may be partially separated from and hinged relative to said outer panel to uncover said dispensing opening upon completely rupturing said outer panel along said lines of weakening, said arcuate intermediate portions of said lines of weakening defining along each side edge of said closure flap a projection having a curved outline, and inner panel having a cut line therein for underlying and being generally aligned with said lines of weakening with the exception of said arcuate intermediate portions, said cut lines defining on said inner panel shoulders behind which said closure flap projections are engageable in the resealing of a resultant container.

14. A container blank according to claim 13 wherein a central portion of said closure flap has a transverse fold line extending between said closure flap side edges for facilitating depressing of said closure flap side edge projections behind said inner panel shoulders.

* * * * *